US007797946B2

(12) United States Patent
Kumar et al.

(10) Patent No.: US 7,797,946 B2
(45) **Date of Patent: *Sep. 21, 2010**

(54) DOUBLE U DESIGN FOR MID-TURBINE FRAME STRUTS

(75) Inventors: Keshava B. Kumar, South Windsor, CT (US); Nagendra Somanath, Manchester, CT (US); William A. Sowa, Simsbury, CT (US)

(73) Assignee: United Technologies Corporation, Hartford, CT (US)

( * ) Notice: Subject to any disclaimer, the term of this patent is extended or adjusted under 35 U.S.C. 154(b) by 958 days.

This patent is subject to a terminal disclaimer.

(21) Appl. No.: 11/634,773

(22) Filed: Dec. 6, 2006

(65) Prior Publication Data

US 2008/0134687 A1 Jun. 12, 2008

(51) Int. Cl.
*F02C 7/20* (2006.01)

(52) U.S. Cl. ..... 60/796; 60/797; 60/798; 475/142; 475/191; 475/209.2; 475/209.3; 475/210.1

(58) Field of Classification Search ..... 60/796, 60/797, 798; 415/142, 213.1, 191, 209.2, 415/209.3, 209.4, 210.1
See application file for complete search history.

(56) References Cited

U.S. PATENT DOCUMENTS

| | | | | |
|---|---|---|---|---|
| 6,708,482 | B2 | 3/2004 | Seda | |
| 6,883,303 | B1 * | 4/2005 | Seda | 60/226.1 |
| 7,594,404 | B2 * | 9/2009 | Somanath et al. | 60/796 |
| 7,610,763 | B2 * | 11/2009 | Somanath et al. | 60/796 |

* cited by examiner

*Primary Examiner*—Michael Cuff
*Assistant Examiner*—Craig Kim
(74) *Attorney, Agent, or Firm*—Kinney & Lange, P.A.

(57) ABSTRACT

A mid-turbine frame is connected to at least one mount of a gas turbine engine for transferring a first load from a first bearing and a second load from a second bearing to the mount. The mid-turbine frame includes a first load structure, a second load structure, and a plurality of struts. The first load structure combines the first load and the second load into a combined load. The second load structure transfers the combined load to the mount. The struts are connected between the first load structure and the second load structure and transfers the combined load from the first load structure to the second load structure.

17 Claims, 4 Drawing Sheets

DOUBLE U DESIGN FOR MID-TURBINE FRAME STRUTS

BACKGROUND OF THE INVENTION

The present invention generally relates to the field of gas turbine engines. In particular, the invention relates to a mid-turbine frame for a jet turbine engine.

Turbofans are a type of gas turbine engine commonly used in aircraft, such as jets. The turbofan generally includes a high and a low pressure compressor, a high and a low pressure turbine, a high pressure rotatable shaft, a low pressure rotatable shaft, a fan, and a combuster. The high-pressure compressor (HPC) is connected to the high pressure turbine (HPT) by the high pressure rotatable shaft, together acting as a high pressure system. Likewise, the low pressure compressor (LPC) is connected to the low pressure turbine (LPT) by the low pressure rotatable shaft, together acting as a low pressure system. The low pressure rotatable shaft is housed within the high pressure shaft and is connected to the fan such that the HPC, HPT, LPC, LPT, and high and low pressure shafts are coaxially aligned.

Outside air is drawn into the jet turbine engine by the fan and the HPC, which increases the pressure of the air drawn into the system. The high-pressure air then enters the combuster, which burns fuel and emits the exhaust gases. The HPT directly drives the HPC using the fuel by rotating the high pressure shaft. The LPT uses the exhaust generated in the combuster to turn the low pressure shaft, which powers the fan to continually bring air into the system. The air brought in by the fan bypasses the HPT and LPT and acts to increase the engine's thrust, driving the jet forward.

In order to support the high and low pressure systems, bearings are located within the jet turbine engine to help distribute the load created by the high and low pressure systems. The bearings are connected to an engine casing that houses a mid-turbine frame located between the HPT and the LPT by bearing support structures. The bearing support structures can be, for example, bearing cones. The loads from the bearing support structures are transferred to the engine casing through the mid-turbine frame. Decreasing the weight of the engine casing can significantly increase the efficiency of the jet turbine engine and the jet itself.

BRIEF SUMMARY OF THE INVENTION

A mid-turbine frame is connected to at least one mount of a gas turbine engine for transferring a first load from a first bearing and a second load from a second bearing to the mount. The mid-turbine frame includes a first load structure, a second load structure, and a plurality of struts. The first load structure combines the first load and the second load into a combined load. The second load structure transfers the combined load to the mount. The struts are connected between the first load structure and the second load structure and transfers the combined load from the first load structure to the second load structure.

DETAILED DESCRIPTION

Figure 1:
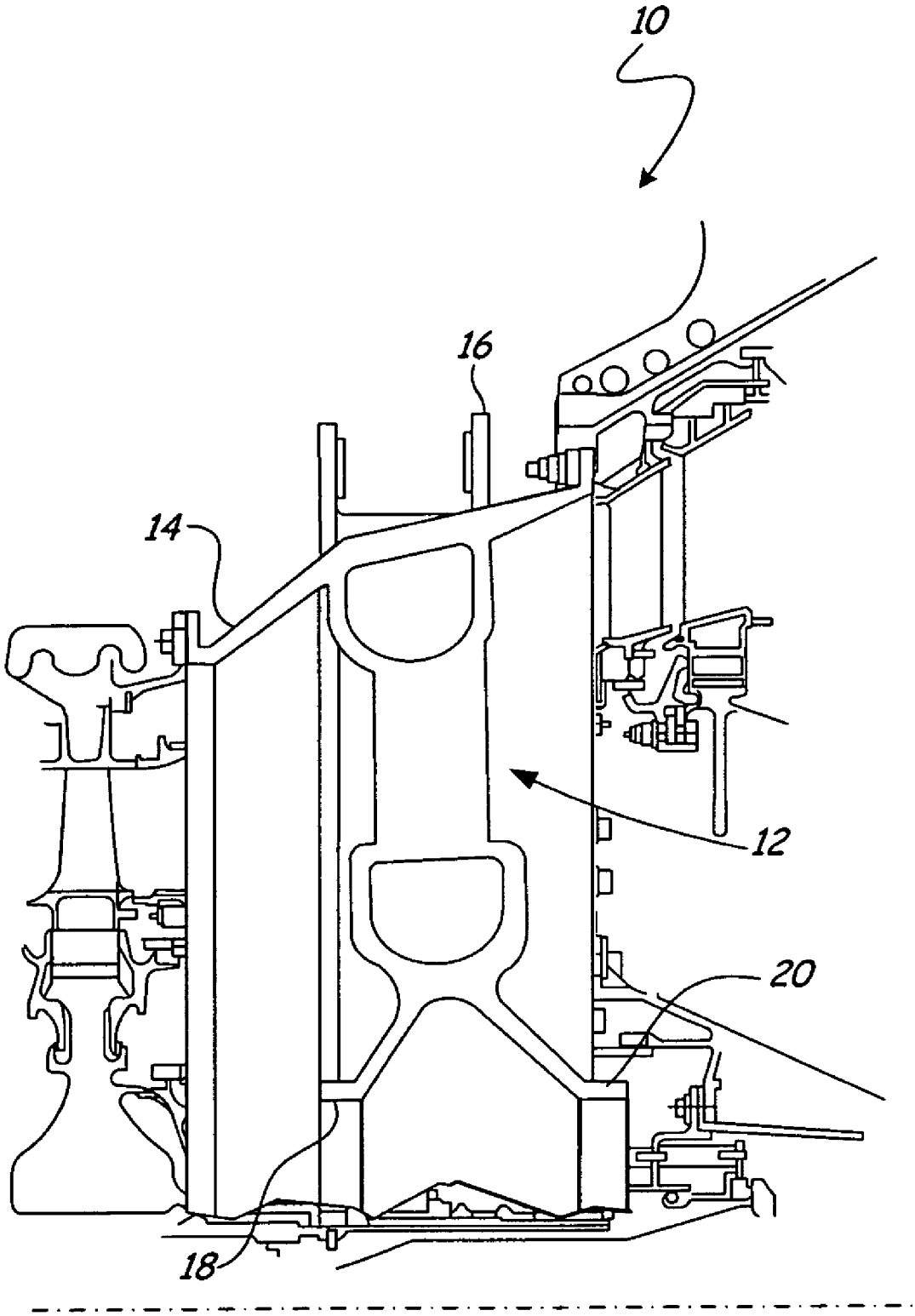
FIG. 1 is a partial sectional view of an intermediate portion of a gas turbine engine.

FIG. 1 shows a partial sectional view of an intermediate portion of a gas turbine engine 10 about a gas turbine engine axis centerline. Gas turbine engine 10 generally includes mid-turbine frame 12, engine casing 14, mounts 16, first bearing 18, and second bearing 20. Mid-turbine frame 12 of gas turbine engine 10 has a lightweight design that efficiently transfers loads from first and second bearings 18 and 20 through mid-turbine frame 12 to engine casing 14. Mid-turbine frame 12 adds stiffness to engine casing 14 and creates a higher load carrying capacity.

Mid-turbine frame 12 is housed within engine casing 14 of gas turbine engine 10 and is connected to engine casing 14 and first and second bearings 18 and 20. Engine casing 14 protects mid-turbine frame 12 from its surroundings and transfers the loads from mid-turbine frame 12 to mounts 16. Due to the design of mid-turbine frame 12, mid-turbine frame 12 has reduced weight compared to current mid-turbine frames available in the art. Mid-turbine frame 12 is applicable in both low thrust engines and high thrust engines having any thrust ratings or operating envelopes.

First and second bearings 18 and 20 are located at forward and aft ends of gas turbine engine 10, respectively, below mid-turbine frame 12. First and second bearings 18 and 20 support thrust loads, vertical tension, side gyroscopic loads, as well as vibratory loads from high and low pressure rotors located in gas turbine engine 10. All of the loads supported by first and second bearings 18 and 20 are transferred to engine casing 14 and mounts 16 through mid-turbine frame 12. Second bearing 20 is typically designed to support a greater load than first bearing 18, so mid-turbine frame 12 is designed for stiffness and structural feasibility assuming that second bearing 20 is the extreme situation.

Figure 2:
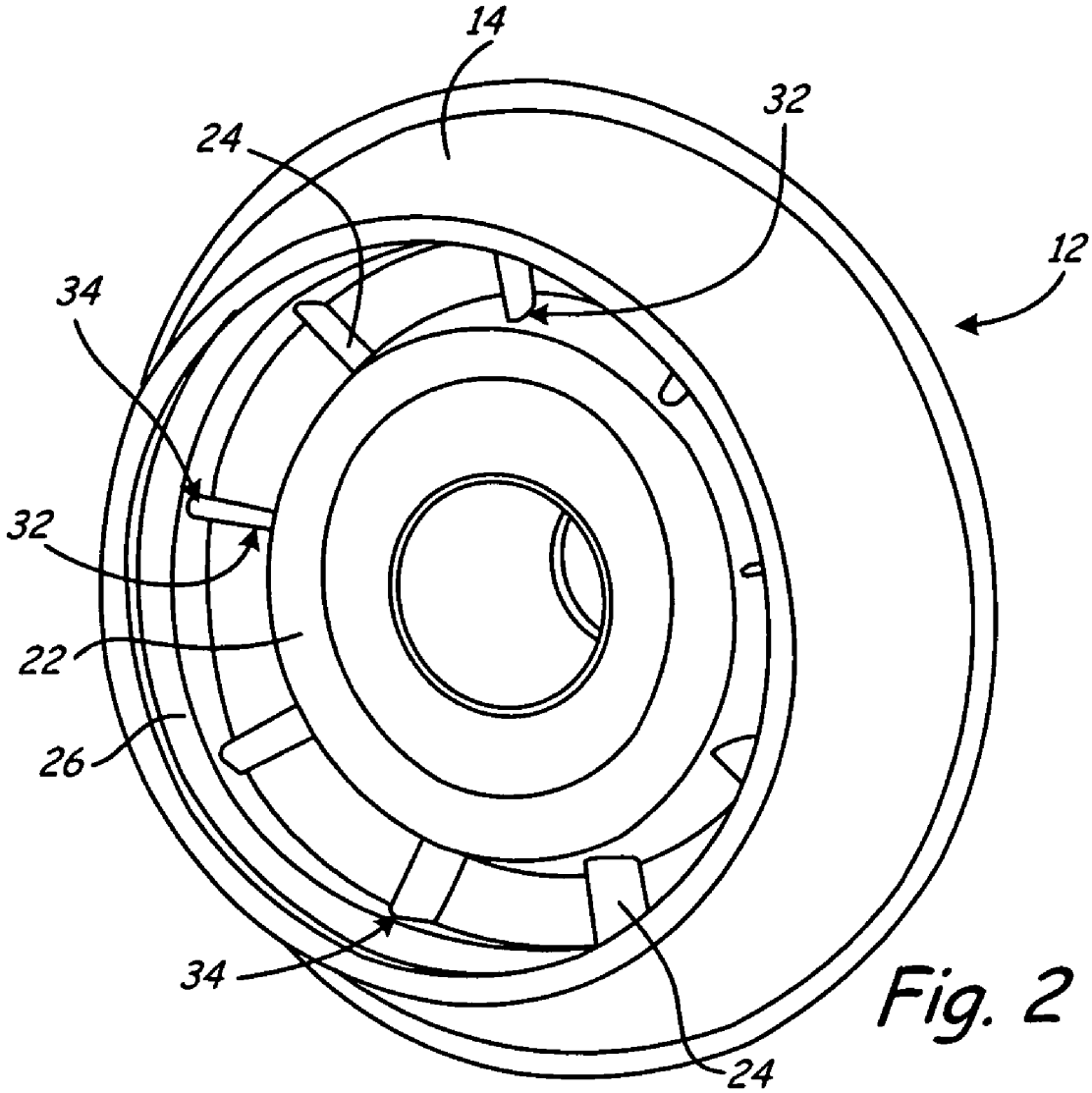
FIG. 2 is an enlarged perspective view of a mid-turbine frame.

FIG. 2 shows an enlarged perspective view of mid-turbine frame 12 within engine casing 14. Mid-turbine frame 12 generally includes first torque box 22, struts 24, and second torque box 26. First and second bearings 18 and 20 (shown in FIG. 1) are connected to mid-turbine frame 12 by first bearing cone 28 and second bearing cone 30 (shown in FIGS. 3, 4A, and 4B), respectively. First and second bearing cones 28 and 30 transfer the loads from first and second bearings 18 and 20 to mid-turbine frame 12 and are stationary relative to continuously rotating high and low pressure rotors.

First torque box 22 has a shell structure and is positioned between first and second bearing cones 28 and 30 and struts 24. First torque box 22 takes the loads, or torque, from first and second bearing cones 28 and 30 and combines them prior to transferring the loads to struts 24, which extend from along the circumference of torque box 22.

Struts 24 of mid-turbine frame 12 extend from first torque box 22 and transfer the loads from first and second bearing cones 28 and 30 entering through first torque box 22 to engine casing 14. Each of struts 24 has a first end 32 connected to first torque box 22 and a second end 34 connected to engine casing 14. The loads travel from torque box 22 through struts 24 to engine casing 14. In one embodiment, nine struts are positioned approximately forty degrees apart from one another along the circumference of first torque box 22. In another embodiment, twelve total struts are positioned approximately thirty degrees apart from one another along the circumference of first torque box 22.

Second torque box 26 is U-shaped and is positioned between struts 24 and engine casing 14. Second torque box 26 takes the loads, or torque, from struts 24 and transfers the loads to engine casing 14.

Figure 3:
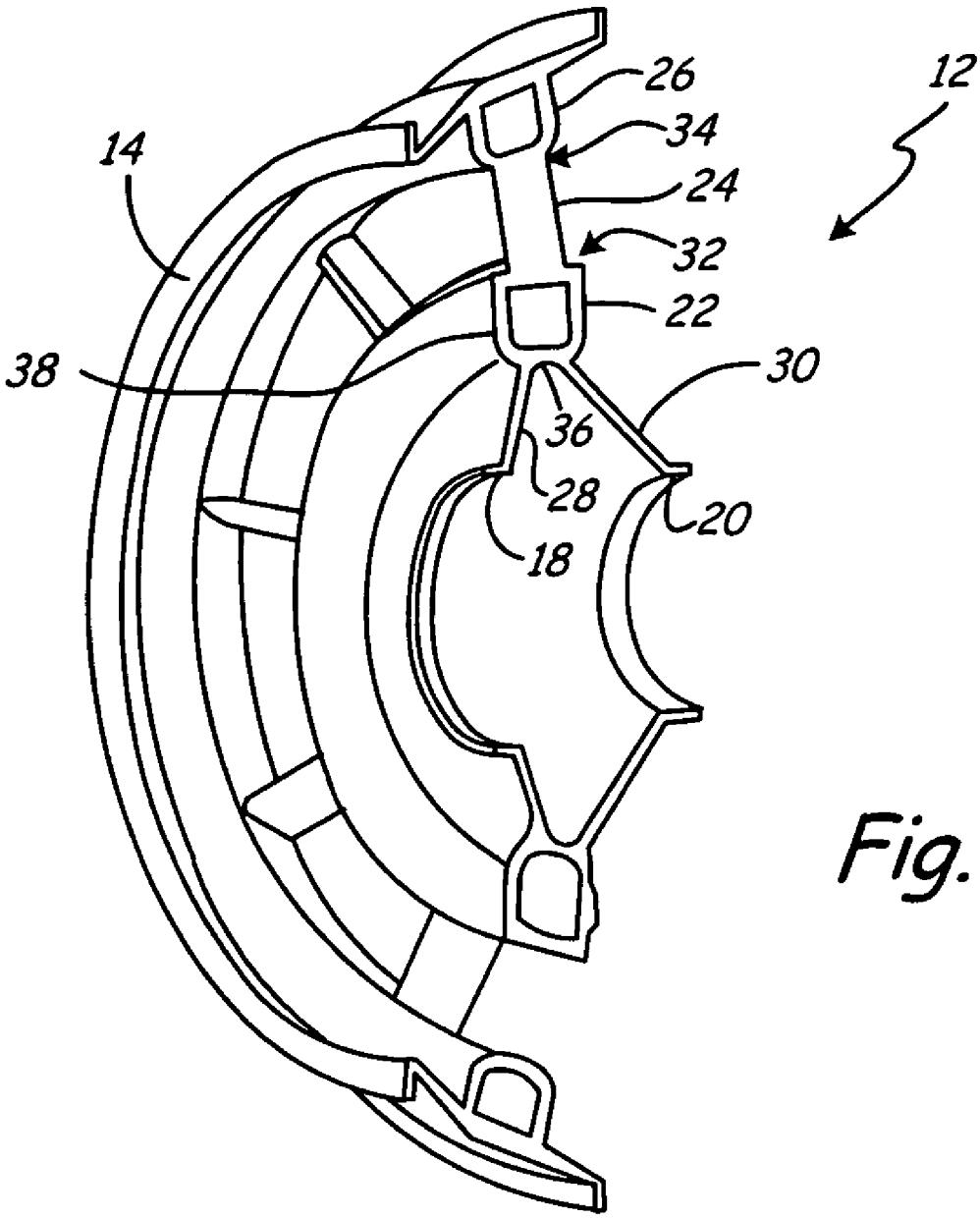
FIG. 3 is a cut-away view of the mid-turbine frame.

FIG. 3 shows a cut-away view of mid-turbine frame 12. As can be seen in FIG. 3, struts 24 connect mid-turbine frame 12 to engine casing 14. First end 32 of struts 24 is connected to first torque box 22 and second end 34 of struts 24 is connected to second torque box 26. Due to the U-shape structures of first and second torque boxes 22 and 26, there is significant load cancellation where struts 24 connect with first and second torque boxes 22 and 26. This allows for the overall length of struts 24 to be decreased, eliminating the need for massive structural components between first and second torque boxes 22 and 24 to transfer the loads from first and second bearings 18 and 20. The shortened length of struts 24 increases the critical buckling load as well as the load carrying capacity of struts 24. In addition to the shortened length, struts 24 may also be hollow, further reducing the weight of mid-turbine frame 12.

In operation, the loads from first and second bearings 18 and 20 are transferred through first and second bearing cones 28 and 30, respectively, and combine at first torque box 22. Struts 24 then carry the loads to second torque box 26, which transfers the combined load through to engine casing 14. The U-shape design of both first torque box 22 and second torque box 26 provides dual U-load transfer areas, allowing efficient load transfer through mid-turbine frame 12 and engine casing 14 to mounts 16. The U-structure is beneficial because of the membrane bending efficiency of shell structures, reducing the overall weight of mid-turbine frame 12.

Although FIG. 3 depicts second torque box 26 as extending all the way around the inner circumference of engine casing 14, the second torque box 26 may optionally not complete a 360 degree rotation around engine casing 14.

Figure 4A:
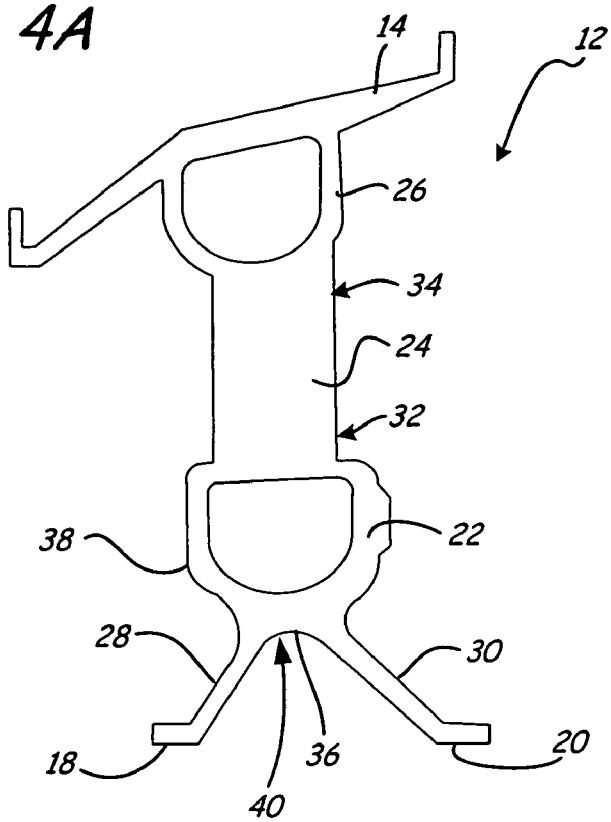
FIG. 4A is a cross-sectional view of a first embodiment of a segment of the mid-turbine frame.

FIG. 4A shows a cross-sectional view of mid-turbine frame 12. First torque box 22 is a U-shape shell structure and generally includes U-stem 36 and U-branch 38. The U-shape shell structure allows first torque box 22 to exhibit both membrane behavior and bending behavior. The membrane behavior of the U-shape shell structure allows first torque box 22 the ability to stretch in the plane. The bending behavior of the U-shape shell structure allows first torque box 22 the ability to deform in a plane orthogonal to the stretching plane. Due to this membrane bending behavior of U-shape shell structure, first torque box 22 can carry more load compared to a plate structure that is in the plane and only exhibits membrane behavior.

U-stem 36 of mid-turbine frame 12 is positioned below first torque box 22 and is formed from first bearing cone 28, second bearing cone 30, and region 40 where first and second bearing cones 28 and 30 merge. The loads of first and second bearing cones 28 and 30 converge to a single point at region 40 where the loads are introduced into torque box 22 by U-stem 36, which carries the effective load. As the loads decompose into components, they are equilibrated along U-branch 38 and are cancelled. U-branch 38 is connected between first torque box 22 and U-stem 36. By connecting U-branch 38 to region 40 of U-stem 36, U-branch 38 can function as a bearing arm load transfer member. U-branch 38 acts as a load transfer member because the loads entering U-branch 38 are smaller than the total load entering first torque box 22. U-branch 38 then subsequently transfers the loads to struts 24. This ensures that the loads from first and second bearings 18 and 20 are transferred through the individual U-branches 38, which provide the effective minimum area needed for load transfer. Because the vertical loads from first and second bearings 18 and 20 are divided, first torque box 22 only needs a small cross-sectional wall area at U-branch 38, allowing thin U-branches 38 and reducing the overall weight of torque box 22. Mid-turbine frame 12 can thus handle large loads without deflecting.

Second torque box 26 is also formed of a U-shape shell structure and functions in substantially the same manner as first torque box 22. Second torque box 26 is connected to engine casing 14 at the top of second torque box 26 and takes the combined load from struts 24 to engine casing 14. The majority of the load from mounts 16 is also taken by second torque box 26. The U-shape of second torque box 26 acts as a local stiffener in the circumferential direction for engine casing 14 and leads to increased local membrane-bending stiffness, enabling local stress redistribution and transfer from struts 24 to engine casing 14.

Figure 4B:
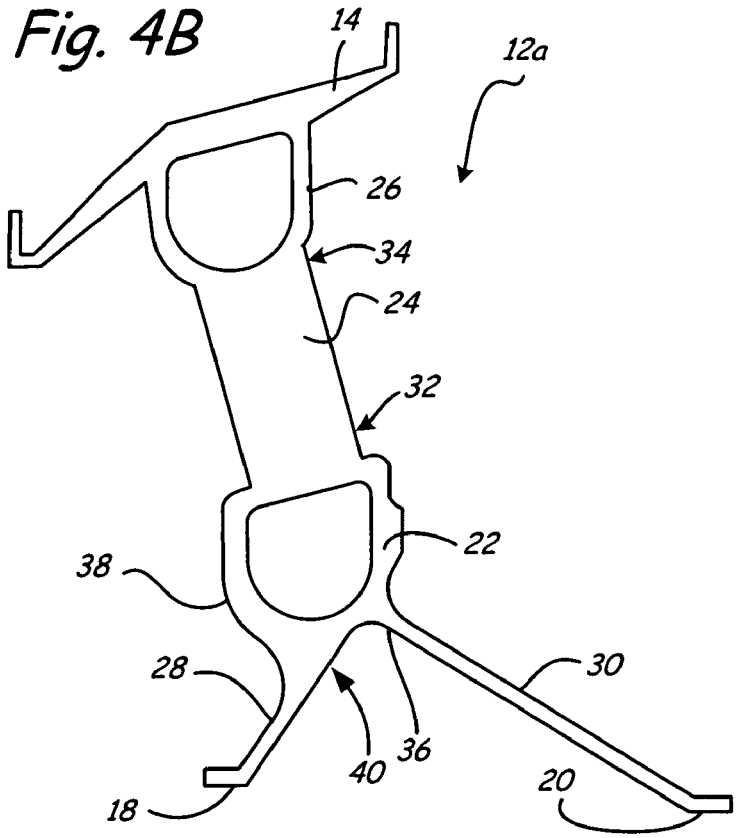
FIG. 4B is a cross-sectional view of a second embodiment of the segment of the mid-turbine frame.

FIG. 4B shows a cross-sectional view of a second embodiment of mid-turbine frame 12*a*. Although FIGS. 1, 3, and 4A depict struts 24 positioned orthogonal with respect to first torque box 22 and second torque box 26, struts 24 may also be tilted with respect to both first torque box 22 and second torque box 26, as shown in FIG. 4B. In the second embodiment of mid-turbine frame 12*a*, the loads from first and second bearings 18 and 20 meet at region 40, but do not meet at the center of region 40. After converging at U-stem 36, the loads propagate into struts 24 along U-stem 36 and U-branch 38, similarly to the first embodiment of mid-turbine frame 12.

The mid-turbine frame design with double U-shaped transfer load structures offers a lightweight structure that efficiently distributes load from a first bearing and a second bearing to a pair of engine mounts. The loads from the first and second bearings first pass through a mid-turbine frame having a plurality of struts that attach the mid-turbine frame to the engine casing. The mid-turbine frame also includes a first U-shaped torque box that combines the loads from the first and second bearings to a first end of the struts. The second end of the struts of the mid-turbine frame is connected to a second torque box which also has a U-shape. The second torque box connects the struts to the engine casing. The dual U-shaped load transfer structures of the mid-turbine frame provide localized stiffening of the mid-turbine frame as well as multi-directional load transfer. In addition, the U-shape of the second torque box shortens the length of the struts, reducing the overall weight of the mid-turbine frame.

Although the present invention has been described with reference to preferred embodiments, workers skilled in the art will recognize that changes may be made in form and detail without departing from the spirit and scope of the invention. For example, the mid-turbine frame may be used in engines of any size and thrust capacity. Depending on the size of the engine, any appropriate number of struts may be used. In addition, all of the components parts of the mid-turbine frame, such as the bearing cones, torque boxes, and struts, may be manufactured separately or may be formed or cast integrally with one another.

The invention claimed is:

1. A mid-turbine frame connected to at least one mount of a gas turbine engine for transferring a first load from a first bearing and a second load from a second bearing to the mount, the mid-turbine frame comprising:

a first U-shaped load structure for combining the first load and the second load into a combined load;

a second load structure for transferring the combined load to the mount;

a plurality of struts connected between the first load structure and the second load structure for transferring the combined load from the first load structure to the second load structure.

2. The mid-turbine frame of claim 1, wherein the second load structure is U-shaped.

3. The mid-turbine frame of claim 1, wherein the first load is transferred to the mid-turbine frame through a first bearing cone and the second load is transferred to the mid-turbine frame through a second bearing cone.

4. The mid-turbine frame of claim 1, wherein the plurality of struts are tilted with respect to the first load structure and the second load structure.

5. The mid-turbine frame of claim 1, wherein the plurality of struts are perpendicular with respect to the first load structure and the second load structure.

6. The mid-turbine frame of claim 1, wherein the first load structure comprises:

a stem for combining the first and second loads into the combined load;

a branch connected to the stem for absorbing a portion of the combined load from the stem; and a first torque box having a first end and a second end, wherein the first end of the first torque box is connected to the stem and the branch, and wherein the second end of the first torque box is connected to the plurality of struts.

7. The mid-turbine frame of claim 6, wherein the first torque box transfers the combined load from the stem and the branch to the plurality of struts.

8. The mid-turbine frame of claim 1, wherein the second load structure comprises a second torque box for accepting the combined load from the plurality of struts, wherein the second torque box has a first end connected to the plurality of struts and a second end connected to the mount.

9. A mid-turbine frame having multidirectional load transfer for transferring a first load and a second load to an engine casing, the mid-turbine frame comprising:

a first U-shaped stiffening structure for combining the first load and the second load;

at least one second stiffening structure for transferring the combined load to the engine casing; and a plurality of struts connecting the first stiffening structure to the second stiffening structure.

10. The mid-turbine frame of claim 9, wherein the second stiffening structure is U-shaped.

11. The mid-turbine frame of claim 9, and further comprising a plurality of second stiffening structures.

12. The mid-turbine frame of claim 9, wherein the first stiffening structure is a first torque box having a ring structure.

13. The mid-turbine frame of claim 9, wherein the second stiffening structure is a second torque box.

14. A lightweight mid-turbine frame for combining and transferring a first load and a second load from a first bearing and a second bearing, respectively, to an engine casing housing the mid-turbine engine, the mid-turbine engine comprising:

a first U-shaped torque box for combining and absorbing the first and second loads;

at least one strut having a first end and a second end, wherein the first end of the strut is connected to the first torque box, and wherein the strut carries the load from the first end of the strut to the second end of the strut; and a second torque box connected to the second end of the strut for transferring the load to the engine casing.

15. The mid-turbine frame of claim 14, wherein the strut is positioned orthogonally with respect to the first torque box and the second torque box.

16. The mid-turbine frame of claim 14, wherein the strut is tilted with respect to the first torque box and the second torque box.

17. The mid-turbine frame of claim 14, wherein the second torque box is U-shaped.

* * * * *